US008552707B2

(12) United States Patent
Chen

(10) Patent No.: US 8,552,707 B2
(45) Date of Patent: Oct. 8, 2013

(54) BANDGAP CIRCUIT AND COMPLEMENTARY START-UP CIRCUIT FOR BANDGAP CIRCUIT

(75) Inventor: Chia-Lung Chen, Sinshih Township, Tainan County (TW)

(73) Assignee: Himax Technologies Limited, Sinshih Township, Tainan County (TW)

( * ) Notice: Subject to any disclaimer, the term of this patent is extended or adjusted under 35 U.S.C. 154(b) by 346 days.

(21) Appl. No.: 13/032,706

(22) Filed: Feb. 23, 2011

(65) Prior Publication Data

US 2012/0212207 A1 Aug. 23, 2012

(51) Int. Cl.
*G05F 3/30* (2006.01)

(52) U.S. Cl.
USPC ..... 323/313; 323/314; 323/901

(58) Field of Classification Search
USPC ..... 323/901, 312–317
See application file for complete search history.

(56) References Cited

U.S. PATENT DOCUMENTS 4,890,052 A * 12/1989 Hellums ..... 323/315
7,372,321 B2 * 5/2008 Krishna et al. ..... 327/541
7,659,705 B2 * 2/2010 Hung ..... 323/313

* cited by examiner

*Primary Examiner* — Harry Behm
(74) *Attorney, Agent, or Firm* — McClure, Qualey & Rodack, LLP

(57) ABSTRACT

A bandgap circuit includes a bias current generating circuit and a complementary start-up circuit. The bias current generating circuit includes a first node and a second node and is arranged to generate a bias current in response to a voltage provided at the first node or a voltage provided at the second node. The complementary start-up circuit is arranged to start-up the bias current generating circuit and includes a first start-up circuit coupled to the first node and a second start-up circuit coupled to the second node. The first and second start-up circuits operate complementarily, so that the second start-up circuit provides the voltage to the second node when the first start-up circuit is unable to provide the voltage to the first node, and the first start-up circuit provides the voltage to the first node when the second start-up circuit is unable to provide the voltage to the second node.

10 Claims, 3 Drawing Sheets

BANDGAP CIRCUIT AND COMPLEMENTARY START-UP CIRCUIT FOR BANDGAP CIRCUIT

BACKGROUND OF THE INVENTION

1. Field of the Invention

The invention relates to a bandgap circuit, and more particularly to a bandgap circuit capable of operating under a fast power sequence.

2. Description of the Related Art

A bandgap circuit is a method of choice for developing a stable voltage reference and providing a bias current. The bandgap circuit is typically coupled with, or directly includes a start-up circuit. The main purpose of the start-up circuit is to start the bandgap circuit. The start-up circuit may ensure that the bandgap circuit operates within a valid operating point. As a supply power (VDDA) ramps up from zero volts to a final value, such as 18V, the bandgap circuit should reach its final value as well. Since it is possible for the bandgap circuit to remain at zero current and zero voltage, one of the start-up circuit's functions is to ensure that the bandgap circuit does not remain at zero current and zero voltage.

However, when the supply power is fast switched between it's ON and OFF states, for example, rapidly turned on and off in milliseconds, the fast power sequence causes the bandgap circuit to function abnormally. FIG. 1 is a schematic diagram showing how the abnormality of the bandgap circuit causes the band defect of a display device to happen. As shown in FIG. 1, the bandgap circuit 101 is a first stage of a circuit to provide a bias current. When the supply power VDDA is fast switched from an OFF state to an ON state as shown, the bias current cannot be successfully established (as the OFF state of the bias current shown in FIG. 1). Without the bias current, the receiver 102, such as a clock generator which receives the bias current to generate a clock signal, cannot generate the clock signal as well. Once the clock signal does not toggle, the logic circuit 103, which operates based on the clock signal, cannot be triggered. Therefore, the red, green or blue bands of a display device cannot be triggered correctly, and their states would be dominated by the corresponding initial states, causing the display band defect. When display band defect happens, the colors displayed by the display device will be incorrect due to the unknown initial states.

In order to solve the above-mentioned problem, a novel bandgap circuit capable of operating under a fast power sequence is highly required.

BRIEF SUMMARY OF THE INVENTION

A bandgap circuit and complementary start-up circuit for a bandgap circuit are provided. An exemplary embodiment of a bandgap circuit comprises a bias current generating circuit and a complementary start-up circuit. The bias current generating circuit comprises a first node and a second node and is arranged to generate a bias current in response to a voltage provided at the first node or a voltage provided at the second node. The complementary start-up circuit comprises a first start-up circuit coupled to the first node and a second start-up circuit coupled to the second node. The first and the second start-up circuits operate complementarily, so that the second start-up circuit provides the voltage to the second node when the first start-up circuit is unable to provide the voltage to the first node, and the first start-up circuit provides the voltage to the first node when the second start-up circuit is unable to provide the voltage to the second node.

An exemplary embodiment of a complementary start-up circuit for starting up a bias current generating circuit comprises a first start-up circuit, coupled to a first node of the bias current generating circuit and a second start-up circuit, coupled to a second node of the bias current generating circuit. The first and the second start-up circuits operate complementarily, so that the second start-up circuit provides a voltage to the second node to trigger the bias current generating circuit to generate a bias current when the first start-up circuit is unable to provide a voltage to the first node, and the first start-up circuit provides the voltage to the first node to trigger the bias current generating circuit to generate the bias current when the second start-up circuit is unable to provide the voltage to the second node.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
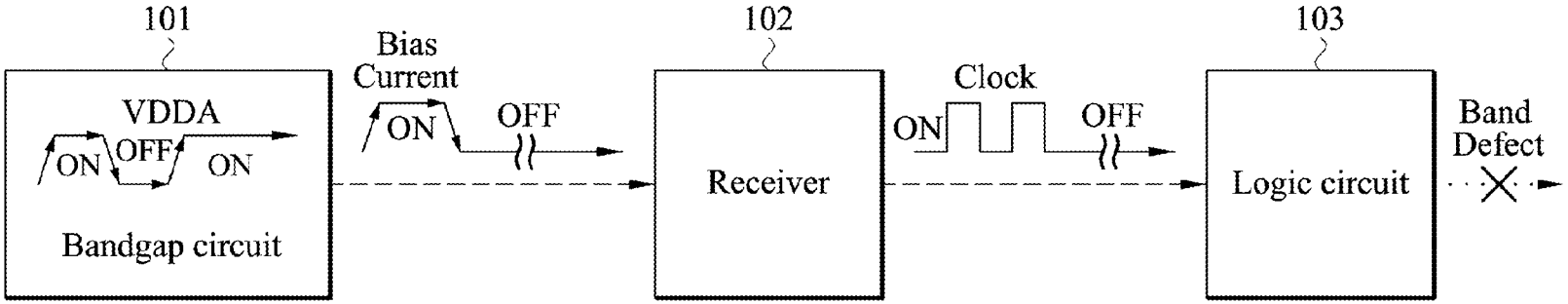
FIG. 1 is a schematic diagram showing how the abnormality of the bandgap circuit causes the band defect of a display device.
Figure 2:
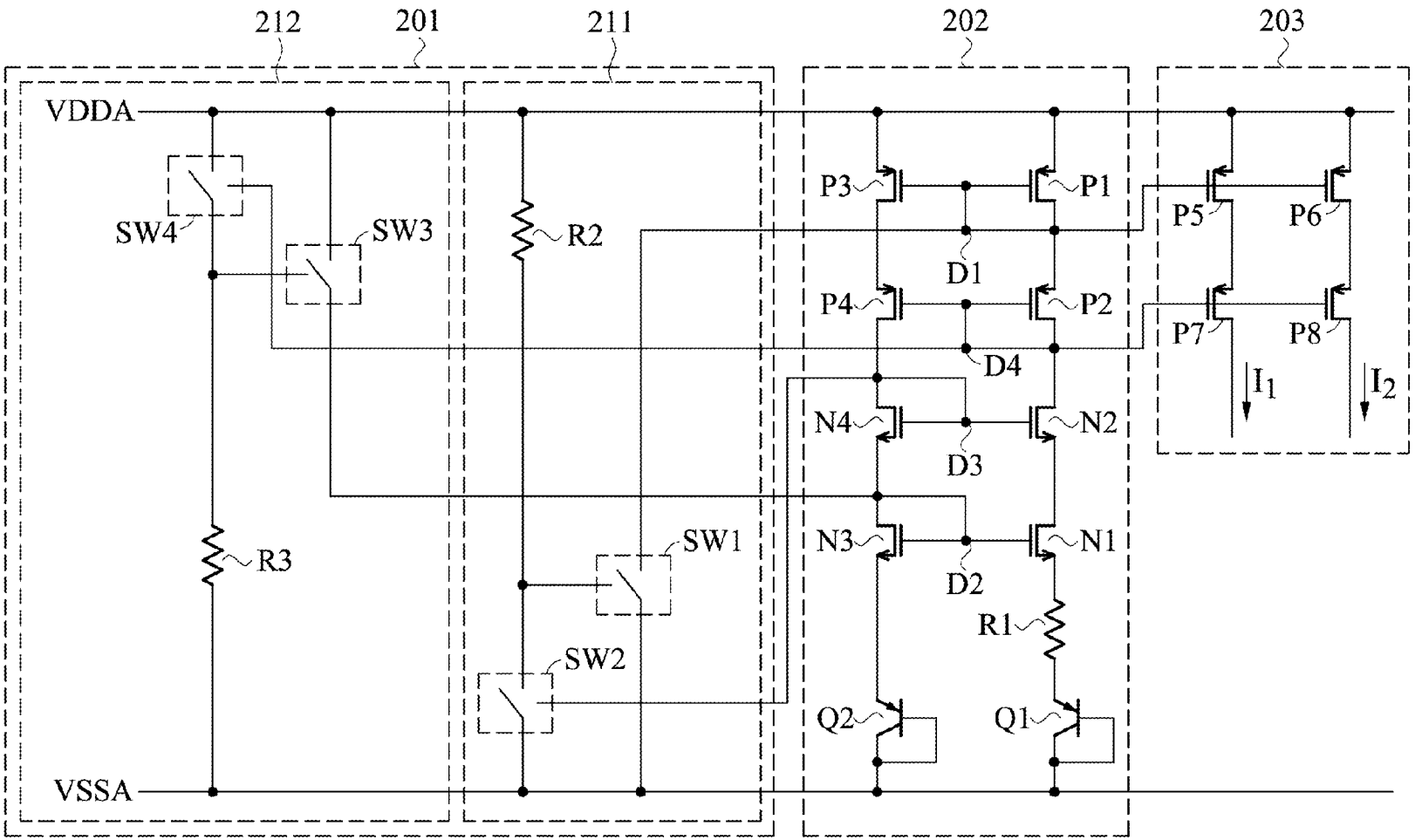
FIG. 2 is a circuit diagram of a bandgap circuit according to an embodiment of the invention.

FIG. 2 is a circuit diagram of a bandgap circuit according to an embodiment of the invention. The bandgap circuit comprises a complementary start-up circuit 201, a bias current generating circuit 202 and a current mirror circuit 203. The complementary start-up circuit 201 is arranged to start-up the bias current generating circuit 202, and comprises a first start-up circuit 211 and a second start-up circuit 212. The bias current generating circuit 202 is arranged to generate a bias current and comprises a resistor R1, a bipolar junction transistor (BJT) pair Q1 and Q2, and a plurality of MOS (metal oxide semiconductor) transistor pairs, such as the MOS transistor pairs P1 and P3, N1 and N3, N2 and N4 and P2 and P4, which is respectively coupled to a first node D1, a second node D2, a third node D3 and a fourth node D4 of the bias current generating circuit 202.

The bias current generating circuit 202 generates the bias current and provides the bias current to the current mirror circuit 203 in the following stage. When receiving the bias current, the current mirror circuit 203 mirrors the bias current via the MOS transistors P5 and P7 to generate a first current I1 for driving, for example, low voltage circuits of a display device. The current mirror circuit 203 further mirrors the bias current via the MOS transistors P6 and P8 to generate a second current I2 for driving, for example, logic circuits of the display device. According to the embodiments of the invention, when the supply power VDDA ramps up from zero volts to a final value, the bias current generating circuit 202 may generate the bias current in response to any disturbance in the MOS transistor pairs. For example, the complementary start-up circuit 201 may provide a voltage to one of the nodes D1-D4, so as to start up the bias current generating circuit 202 for generating the bias current.

As shown in FIG. 2, the first start-up circuit 211 comprises a first switch SW1 coupled to the first node D1 of the bias current generating circuit 202, a second switch SW2 coupled to the third node D3 of the bias current generating circuit 202 and a resistor R2. The second start-up circuit 212 comprises a third switch SW3 coupled to the second node D2 of the bias current generating circuit 202, a fourth switch SW4 coupled to the fourth node D4 of the bias current generating circuit 202 and a resistor R3. According to an embodiment of the invention, the first start-up circuit 211 and the second start-up circuit 212 may operate complementarily, so that the second start-up circuit 212 may provide the voltage to the second node D2 when the first start-up circuit 211 is unable to provide the voltage to the first node D1, and the first start-up circuit 211 may provide the voltage to the first node D1 when the second start-up circuit 212 is unable to provide the voltage to the second node D2. For example, when the second switch SW2 is turned off, the first switch SW1 may be turned on in response to the ramping up of the supply power VDDA, so as to provide the voltage to the first node D1 and start up the bias current generating circuit 202. When the second switch SW2 is turned on, the first switch SW1 and the fourth switch SW4 may be turned off and the third switch SW3 may be turned on in response to the ramping up of the supply power VDDA, so as to provide the voltage to the second node D2 and start up the bias current generating circuit 202.

Figure 3:
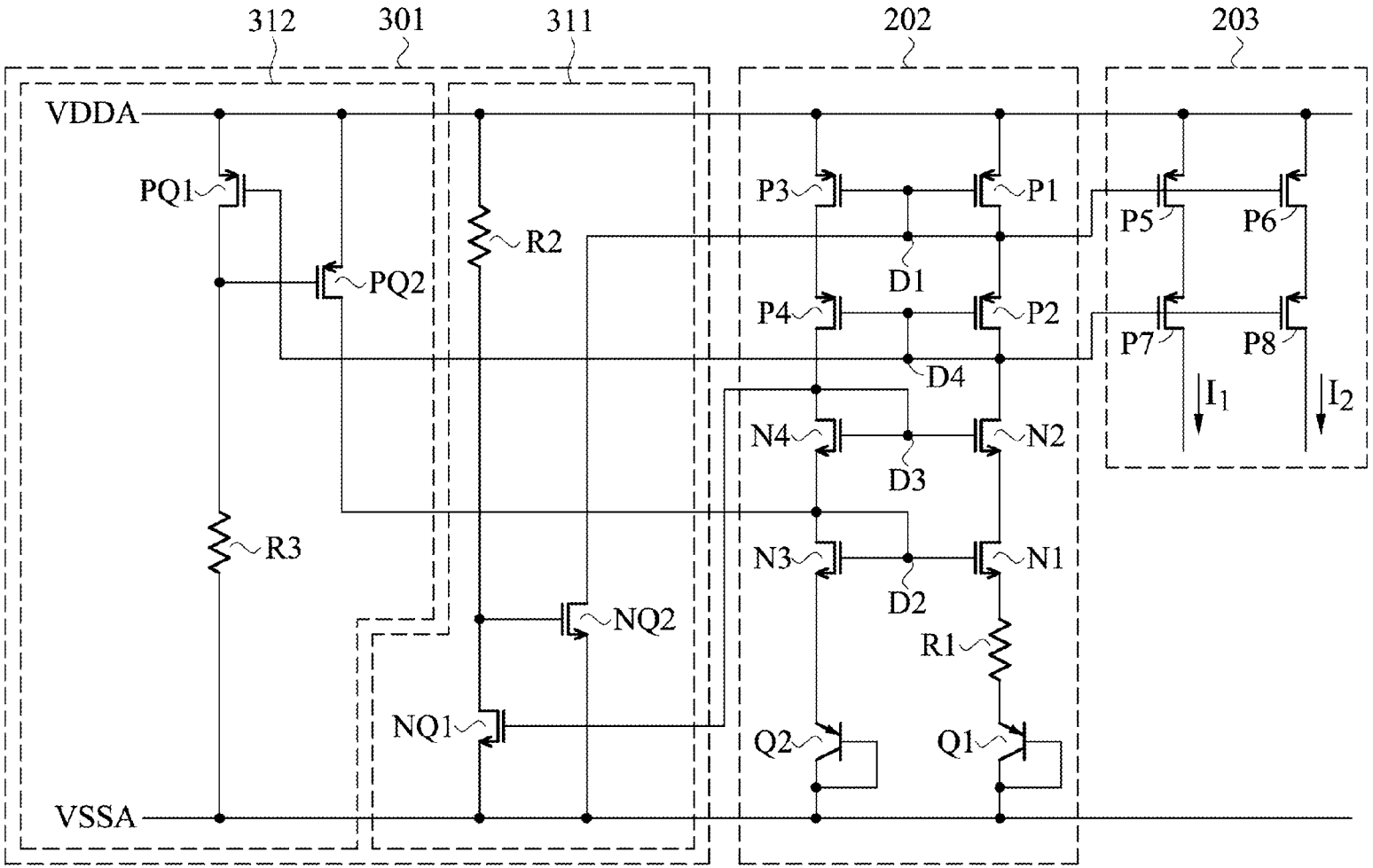
FIG. 3 is a circuit diagram of a bandgap circuit according to another embodiment of the invention.

FIG. 3 is a circuit diagram of a bandgap circuit according to another embodiment of the invention. In the embodiment, the first switch SW1 and the second switch SW2 may be implemented by a first type of MOS transistors, such as the NMOS transistors NQ2 and NQ1 as shown, and the third switch SW3 and the fourth switch SW4 may be implemented by a second type of MOS transistors, such as the PMOS transistors PQ2 and PQ1 as shown. Note that FIG. 3 merely shows one embodiment of the invention and implementations of the switches SW1 to SW4 should not be limited thereto.

As shown in FIG. 3, the transistor NQ2 has a first electrode coupled to the first node D1, a second electrode coupled to the supply power VDDA and the transistor NQ1, and a third electrode coupled to a ground (VSSA). The transistor NQ1 has a first electrode coupled to the transistor NQ2 and the supply power VDDA, a second electrode coupled to the third node D3 and a third electrode coupled to the ground. According to an embodiment of the invention, the transistor NQ2 is turned on or off according to the voltage of the supply power VDDA and an on or off status of the transistor NQ1, and the transistor NQ1 is turned on or off according to a voltage at the third node D3 of the bias current generating circuit 202.

The transistor PQ2 has a first electrode coupled to the supply power VDDA, a second electrode coupled to the transistor PQ1 and the ground and a third electrode coupled to the second node D2 of the bias current generating circuit 202. The transistor PQ1 has a first electrode coupled to the supply power VDDA, a second electrode coupled to the fourth node D4 of the bias current generating circuit 202 and a third electrode coupled to the ground. According to an embodiment of the invention, the transistor PQ2 is turned on or off according to the voltage of the supply power VDDA and an on or off status of the transistor PQ1, and the transistor PQ1 is turned on or off according to a voltage at the fourth node D4 of the bias current generating circuit 202.

Before a start-up procedure begins, the supply power VDDA is turned off (i.e. zero volts) and all the transistors in the complementary start-up circuit 301 are turned off. When the start-up procedure begins, the supply power VDDA is turned on and the voltage of the supply power VDDA begins to ramp up from zero volts to a final value, for example, 18 volts. The transistor NQ2 in the complementary start-up circuit 301 is first turned on after the voltage of the supply power VDDA becomes greater than its threshold voltage, and couples the first node D1 to the ground. The MOS transistors P3 and P1 are turned on in response to the low voltage provided at the first node D1. After the MOS transistors P3 and P1 are turned on, the bias current is induced in the path between the MOS transistors P3 and P1 and BJTs Q1 and Q2. The induced bias current triggers the current mirror circuit 203 to generate the first and second currents I1 and I2. After the bias current is built, the voltage at the third node D3 rises up to turn on the transistor NQ1, and then causing the transistor NQ2 to be turned off. After the transistor NQ2 is turned off, the start-up procedure is completed.

However, when the supply power VDDA is fast switched from an OFF state to an ON state, the short OFF time may be insufficient for the third node D3 to discharge to the ground. Under this condition, when the supply power VDDA is turned on again, the transistor NQ1 cannot be turned off, causing the NQ2 to be turned off, and the low voltage cannot be provided to the first node D1 to start up the bias current generating circuit 202.

To solve the problem, the second start-up circuit 312 is implemented complementarily, so as to facilitate the bandgap circuit to work under a fast power sequence. As previously described, when the third node D3 is unable to discharge to the ground, the fourth node D4 is unable to discharge to the ground. The high voltage at the fourth node D4 causes the transistor PQ1 to be turned off, making the second electrode of the transistor PQ2 couple to the ground. When the supply power VDDA is fast switched from an OFF state to an ON state, the transistor PQ2 is turned on after the voltage of the supply power VDDA becomes greater than its threshold voltage, and then couples the second node D2 to the supply power VDDA.

The MOS transistors N3 and N1 are turned on in response to the high voltage provided at the second node D2. After the MOS transistors N3 and N1 are turned on, the bias current is induced in the path between the MOS transistors P3 and P1 and BJTs Q1 and Q2. Therefore, even if the first start-up circuit 311 is unable to provide voltage to the first node D1 to start up the bias current generating circuit 202 when the supply power VDDA is fast switched from an OFF state to an ON state, the start-up procedure may still be triggered by the second start-up circuit 312 so as to start up the bias current generating circuit 202. In this manner, a bandgap circuit capable of operating under a fast power sequence can be achieved.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A bandgap circuit, comprising:

a bias current generating circuit, comprising a first node and a second node and arranged to generate a bias current in response to a voltage provided at the first node or a voltage provided at the second node; and a complementary start-up circuit, arranged to start-up the bias current generating circuit and comprising:

a first start-up circuit, coupled to the first node; and a second start-up circuit, coupled to the second node, wherein the first and the second start-up circuits operate complementarily, so that the second start-up circuit provides the voltage to the second node when the first start-up circuit is unable to provide the voltage to the first node, and the first start-up circuit provides the voltage to the first node when the second start-up circuit is unable to provide the voltage to the second node, the first start-up circuit comprises at least a first switch coupled to the first node of the bias current generating circuit and a second switch coupled to a third node of the bias current generating circuit, and the second start-up circuit comprises at least a third switch coupled to the second node of the bias current generating circuit and a fourth switch coupled to a fourth node of the bias current generating circuit, and wherein when the second switch is turned off, the first switch is turned on in response to ramping up of a supply power so as to provide the voltage to the first node and start up the bias current generating circuit, and when the second switch is turned on, the first switch and the fourth switch are turned off and the third switch is turned on in response to ramping up of the supply power, so as to provide the voltage to the second node and start up the bias current generating circuit.

2. The bandgap circuit as claimed in claim 1, wherein the first and second switches are a first type of MOS (metal oxide semiconductor) transistors and the third and fourth switches are a second type of MOS transistors.

3. The bandgap circuit as claimed in claim 2, wherein the first switch is a first first type of MOS transistor, having a first electrode coupled to the first node, a second electrode coupled to a supply power and a third electrode coupled to a ground, the second switch is a second first type of MOS transistor, having a first electrode coupled to the first switch and the supply power, a second electrode coupled to the third node and a third electrode coupled to the ground, and wherein the first switch is turned on or off according to the supply power and an on or off status of the second switch, and the second switch is turned on or off according to a voltage at the third node of the bias current generating circuit.

4. The bandgap circuit as claimed in claim 2, wherein the third switch is a first second type of MOS transistor, having a first electrode coupled to a supply power, a second electrode coupled to the fourth switch and a ground and a third electrode coupled to the second node, the fourth switch is a second second type of MOS transistor, having a first electrode coupled to the supply power, a second electrode coupled to the fourth node and a third electrode coupled to the ground, and wherein the third switch is turned on or off according to the supply power and an on or off status of the fourth switch, and the fourth switch is turned on or off according to a voltage at the fourth node of the bias current generating circuit.

5. The bandgap circuit as claimed in claim 1, wherein the bias current generating circuit further comprises a plurality of MOS transistor pairs, wherein each MOS transistor pair is coupled to one of the first, second, third and forth switches.

6. A complementary start-up circuit for starting up a bias current generating circuit, comprising:

a first start-up circuit, coupled to a first node of the bias current generating circuit; and a second start-up circuit, coupled to a second node of the bias current generating circuit, wherein the first and the second start-up circuits operate complementarily, so that the second start-up circuit provides a voltage to the second node to trigger the bias current generating circuit to generate a bias current when the first start-up circuit is unable to provide a voltage to the first node, and the first start-up circuit provides the voltage to the first node to trigger the bias current generating circuit to generate the bias current when the second start-up circuit is unable to provide the voltage to the second node, wherein the first start-up circuit comprises at least a first switch coupled to the first node of the bias current generating circuit and a second switch coupled to a third node of the bias current generating circuit, and the second start-up circuit comprises at least a third switch coupled to the second node of the bias current generating circuit and a fourth switch coupled to a fourth node of the bias current generating circuit, and wherein when the second switch is turned off, the first switch is turned on in response to ramping up of a supply power so as to provide the voltage to the first node and start up the bias current generating circuit, and when the second switch is turned on, the first switch and the fourth switch are turned off and the third switch is turned on in response to ramping up of the supply power, so as to provide the voltage to the second node and start up the bias current generating circuit.

7. The complementary start-up circuit as claimed in claim 6, wherein the first and second switches are a first type of MOS (metal oxide semiconductor) transistors and the third and fourth switches are a second type of MOS transistors.

8. The complementary start-up circuit as claimed in claim 7, wherein the first switch is a first first type of MOS transistor, having a first electrode coupled to the first node, a second electrode coupled to a supply power and a third electrode coupled to a ground, the second switch is a second first type of MOS transistor, having a first electrode coupled to the first switch and the supply power, a second electrode coupled to the third node and a third electrode coupled to the ground, and wherein the first switch is turned on or off according to the supply power and an on or off status of the second switch, and the second switch is turned on or off according to a voltage at the third node of the bias current generating circuit.

9. The complementary start-up circuit as claimed in claim 7, wherein the third switch is a first second type of MOS transistor, having a first electrode coupled to a supply power, a second electrode coupled to the fourth switch and a ground and a third electrode coupled to the second node, the fourth switch is a second second type of MOS transistor, having a first electrode coupled to the supply power, a second electrode coupled to the fourth node and a third electrode coupled to the ground, and wherein the third switch is turned on or off according to the supply power and an on or off status of the fourth switch, and the fourth switch is turned on or off according to a voltage at the fourth node of the bias current generating circuit.

10. The complementary start-up circuit as claimed in claim 6, wherein the first, second, third and forth switches are coupled to one of a plurality of MOS transistor pairs comprised in the bias current generating circuit, respectively.

* * * * *